US006711369B2

(12) United States Patent
Lee et al.

(10) Patent No.: US 6,711,369 B2
(45) Date of Patent: Mar. 23, 2004

(54) PHOTOSENSITIVE DRUM STRUCTURE FOR IMAGE FORMING APPARATUS USING PHOTOSENSITIVE BELT

(75) Inventors: Jin-soo Lee, Gyeonggi-do (KR); Sam-seuk Choi, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/186,973

(22) Filed: Jul. 2, 2002

(65) Prior Publication Data

US 2003/0161661 A1 Aug. 28, 2003

(30) Foreign Application Priority Data

Feb. 26, 2002 (KR) ..... 2002-10261

(51) Int. Cl.[7] ..... B41J 2/435; G03G 21/00
(52) U.S. Cl. ..... 399/159; 430/56
(58) Field of Search ..... 430/59, 56; 399/162, 399/165, 159

(56) References Cited

U.S. PATENT DOCUMENTS 4,972,232 A 11/1990 Hoover et al.
5,337,123 A * 8/1994 Fisher ..... 355/212
6,088,557 A * 7/2000 Janssen et al. ..... 399/165

FOREIGN PATENT DOCUMENTS

| | | |
|---|---|---|
| KR | 1999-25955 | 7/1999 |
| KR | 2000-9557 | 2/2000 |
| KR | 2000-5804 | 4/2000 |

* cited by examiner

*Primary Examiner*—John Goodrow
(74) *Attorney, Agent, or Firm*—Staas & Halsey LLP

(57) ABSTRACT

A photosensitive drum structure for an image forming apparatus. The photosensitive drum structure includes a cylindrical rotary drum having steps at both ends of the circumferential surface thereof, and a photosensitive belt being wound around the rotary drum and attached thereto with an adhesive that is adhered to the steps. Here, a gap is formed between the circumferential surface of the rotary drum and the photosensitive belt. Thus, an inexpensive photosensitive belt is wound around a rotary drum, and a photosensitive drum can be manufactured with a low cost. Also, a nip having a predetermined width is formed on a contact surface between a developer roller and the photosensitive drum, thereby improving development of the image.

14 Claims, 6 Drawing Sheets

PHOTOSENSITIVE DRUM STRUCTURE FOR IMAGE FORMING APPARATUS USING PHOTOSENSITIVE BELT

CROSS-REFERENCE TO RELATED APPLICATIONS

This application claims the benefit of Korean Application No. 2002-10261, filed Feb. 26, 2002, in the Korean Industrial Property Office, the disclosure of which is incorporated herein by reference.

BACKGROUND OF THE INVENTION

1. Field of the Invention

The present invention relates to a photosensitive drum structure for an image forming apparatus using a photosensitive belt, and more particularly, to a photosensitive drum structure for an image forming apparatus used in an electrophotographic printer.

2. Description of the Related Art

In general, an electrophotographic printer such as a laser printer forms a latent electrostatic image on a photosensitive medium, develops the latent electrostatic image with a toner having a predetermined color, and transfers the developed toner image to a printing paper in order to obtain a desired image. The photosensitive medium is typically a photosensitive belt or a photosensitive drum.

FIG. 1 is a view of a portion of an image forming apparatus using a known photosensitive belt as a photosensitive medium. Referring to FIG. 1, the rotation path of a photosensitive belt 10 that travels a continuous path due to rollers 10*a*, 10*b*, and 10*c* includes an eraser 12, a charger 14, a laser scanning unit (LSU) 16, and a plurality of developing units 18*a*, 18*b*, 18*c*, and 18*d*. The eraser 12 erases charges on the photosensitive belt 10. The charger 14 charges the photosensitive belt 10 with a predetermined electric potential. The LSU 16 radiates light onto the photosensitive belt 10 to form a latent electrostatic image. The plurality of developing units 18*a*, 18*b*, 18*c*, and 18*d* are disposed in series along the travel direction of the photosensitive belt 10 and each develops the latent electrostatic image as a toner image with a different color. The developed toner image is transferred to a transfer belt 20 that circulates in contact with the photosensitive belt 10.

However, in the above-described transfer method, the photosensitive belt 10 may move laterally outside of a transfer range of the image. Thus, a steering unit (not shown) is needed to adjust the photosensitive belt 10.

FIG. 2 is a view of a portion of an image forming apparatus using a photosensitive drum as a photosensitive medium to solve the problems caused by the use of a photosensitive belt. Elements that are the same as those in FIG. 1 are described with the same numerals, and thus their detailed descriptions are omitted.

Referring to FIG. 2, instead of the photosensitive belt 10 of FIG. 1, a large-sized photosensitive drum 30 is used. A plurality of developing units 28 to develop a latent electrostatic image on the photosensitive drum 30 are disposed along the circumferential surface of the photosensitive drum 30. Developer rollers 28*a*, 28*b*, 28*c*, and 28*d* are positioned at the tip of each developing unit 28. The developer rollers 28*a*, 28*b*, 28*c*, and 28*d* contact the photosensitive drum 30 and develop the latent electrostatic image with a toner in the developing units 28 with a developing nip N, having a predetermined width.

However, a different problem occurs in the manufacture of the photosensitive drum 30. That is, if a small-sized photosensitive drum 30 having a diameter of 25–32 mm is manufactured, a small-sized rotary drum having a diameter of 25–32 mm is dipped in a container containing a photosensitive solution to form a photosensitive layer on the surface of the rotary drum. In this case, a plurality of small-sized rotary drums are manufactured at the same time, and thus manufacturing costs are low. However, since the photosensitive drum 30 uses a large-sized rotary drum having a diameter of about 150 mm, it is difficult to dip multiple rotary drums in the container containing the photosensitive solution. Also, it is expensive to manufacture the photosensitive drum 30. Further, since the photosensitive drum 30 is rigid, the developing N must be narrow, and the developing units 28 do not develop the image well.

SUMMARY OF THE INVENTION

Accordingly, it is an object of the present invention to provide a photosensitive drum structure for an image forming apparatus in which a gap to provide a cushion between a rotary drum and a photosensitive belt is formed by adhering the photosensitive belt on steps having a predetermined height that are formed at both ends of the circumferential surface of the rotary drum.

Additional objects and advantages of the invention will be set forth in part in the description which follows and, in part, will be obvious from the description, or may be learned by practice of the invention.

The foregoing and other objects of the present invention are achieved by providing a photosensitive drum for an image forming apparatus, the drum including a cylindrical rotary drum having steps at both ends of a circumferential surface thereof, and a photosensitive belt wound around the rotary drum and attached thereto with an adhesive adhered to the steps, wherein a gap is formed between the circumferential surface of the rotary drum and the photosensitive belt.

According to an aspect of the present invention, the gap is filled with air or an elastic member.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
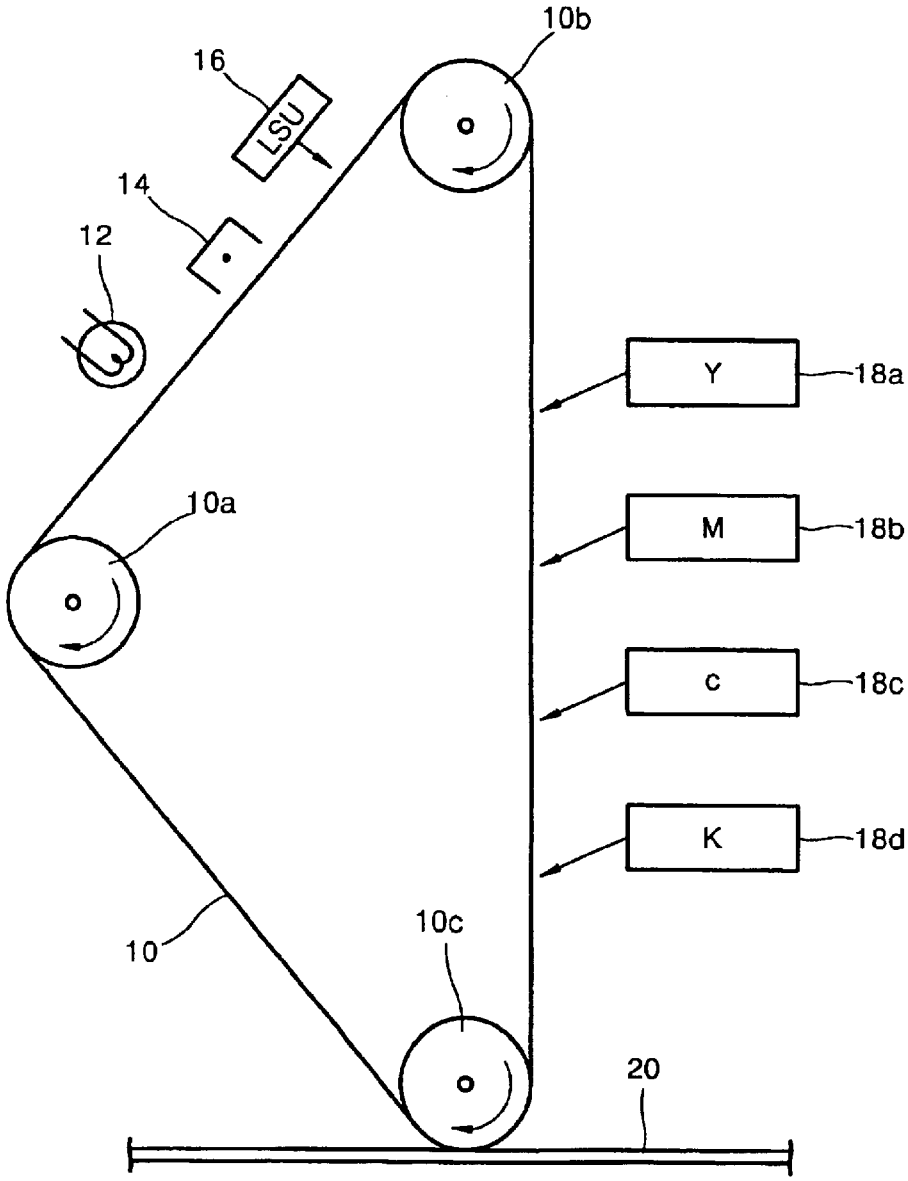
FIG. 1 (PRIOR ART)
FIG. 1 is a view of a portion of an image forming apparatus using a known photosensitive belt.
Figure 2:
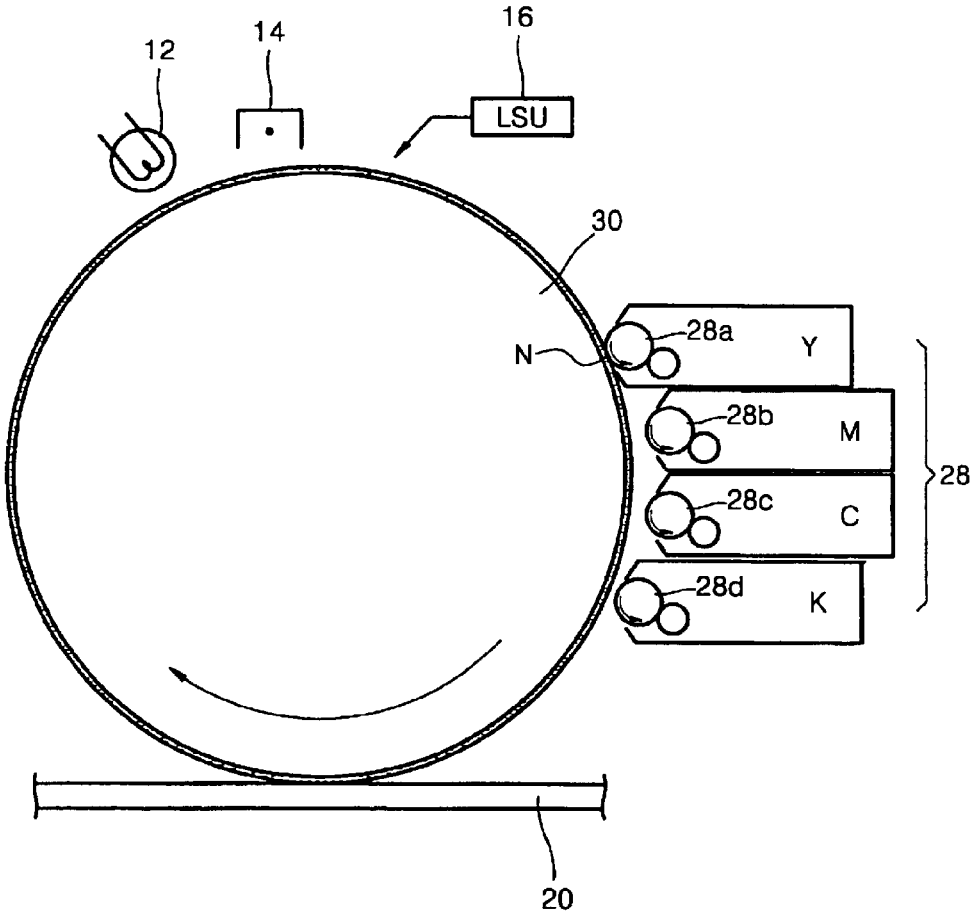
FIG. 2 (PRIOR ART)
FIG. 2 is a view of a portion of an image forming apparatus using a known photosensitive drum.

Reference will now be made in detail to the present preferred embodiments of the present invention, examples of which are illustrated in the accompanying drawings, wherein like reference numerals refer to like elements throughout. In the drawings, the thicknesses of layers or regions are exaggerated for clarity.

Figure 3:
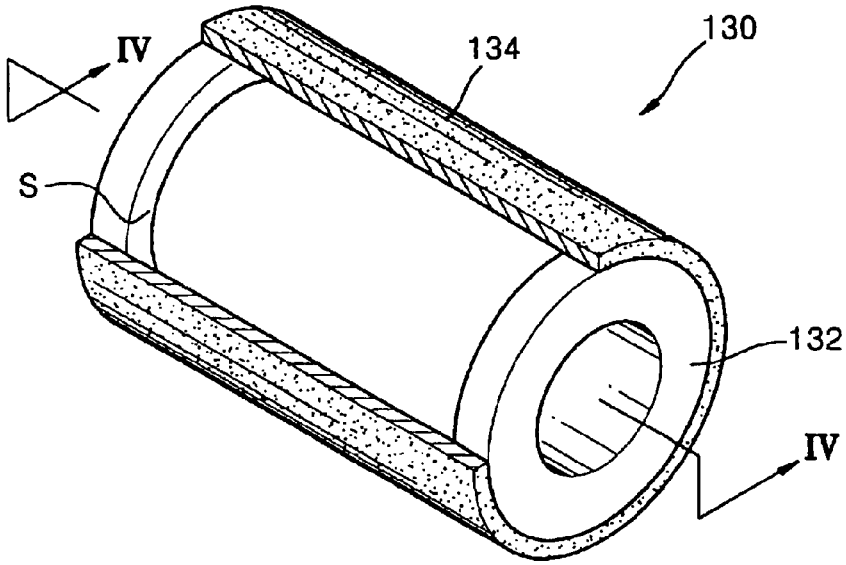
FIG. 3 is a perspective view of a photosensitive drum structure according to a first embodiment of the present invention.
Figure 4:
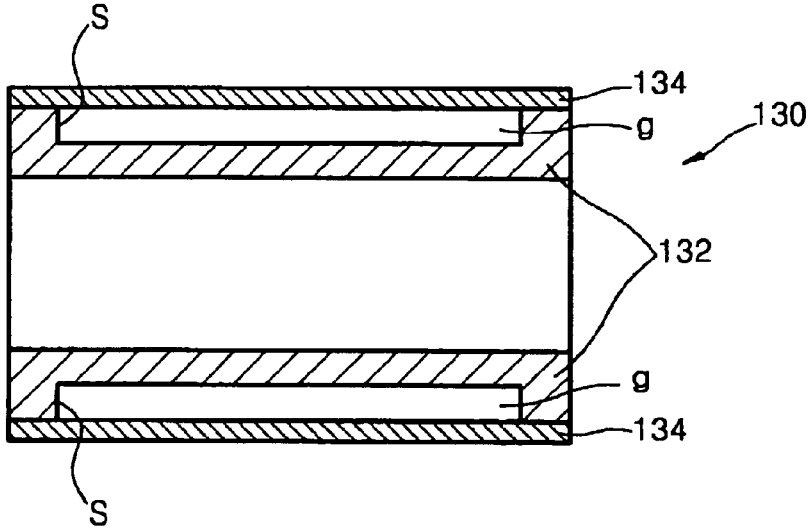
FIG. 4 is a cross-sectional view taken along line IV—IV of FIG. 3.

FIG. 3 is a perspective view of a photosensitive drum structure 130 according to a first embodiment of the present invention, and FIG. 4 is a cross-sectional view taken along line IV—IV of FIG. 3. Referring to FIGS. 3 and 4, steps S having a predetermined height are formed at both ends of the circumferential surface of a cylindrical rotary drum 132 made of aluminium or an aluminium alloy. Double-sided tapes (not shown) are adhered on the steps S, on which a photosensitive belt 134 is wound one turn, covering the circumferential surface of the rotary drum 132. The steps S form an air gap g between the circumferential surface of the rotary drum 132 and the photosensitive belt 134. The photosensitive belt 134 is formed of a sequential stack of a base layer, a conductive layer, and a photosensitive layer. When a laser is radiated onto the surface of the photosensitive belt 134, electrons of the photosensitive layer pass through the conductive layer to the outside, thereby forming a latent electrostatic image. The thickness of the photosensitive belt 134 is generally 20–1000 $\mu$m.

A height of the steps S, which defines the length of the air gap g, may be 100 $\mu$m or more. The maximum height of the steps S is generally 2 mm or less. A width of the steps S may be at least 2 mm or more.

Figure 5:
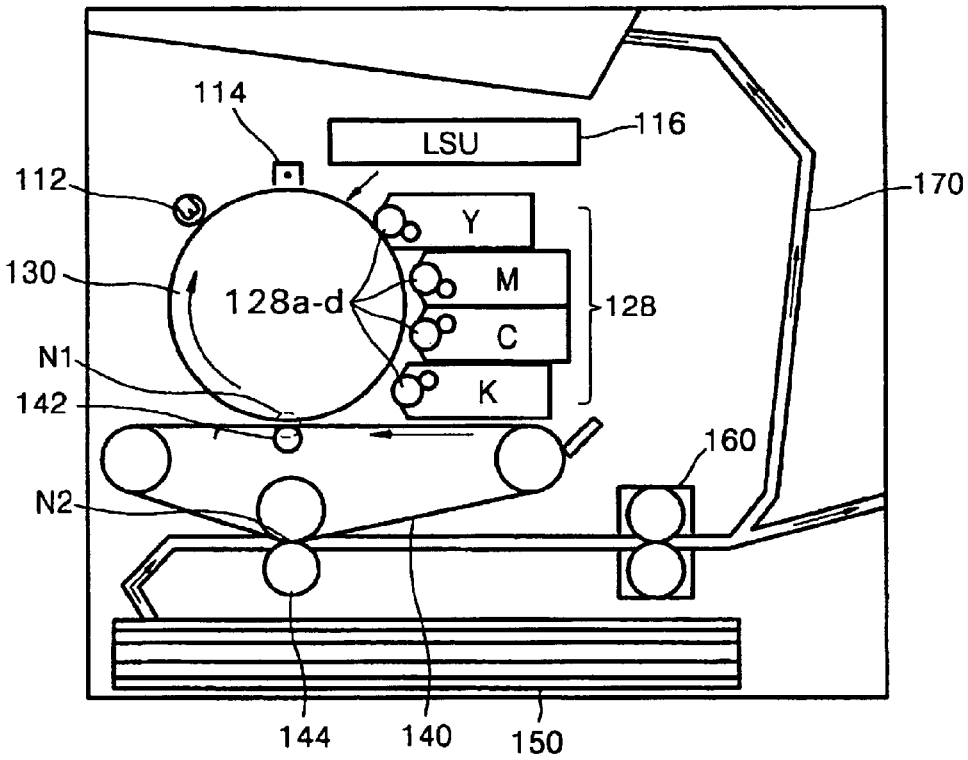
FIG. 5 is a schematic view of a printer using the photosensitive drum according to the first embodiment of the present invention.

The operation of the drum 130 having the above-described structure will be described with reference to FIGS. 5 and 6. FIG. 5 is a schematic view of a printer using the photosensitive drum 130 according to the first embodiment of the present invention, and FIG. 6 is an enlarged view of a portion of the schematic view shown in FIG. 5.

Figure 6:
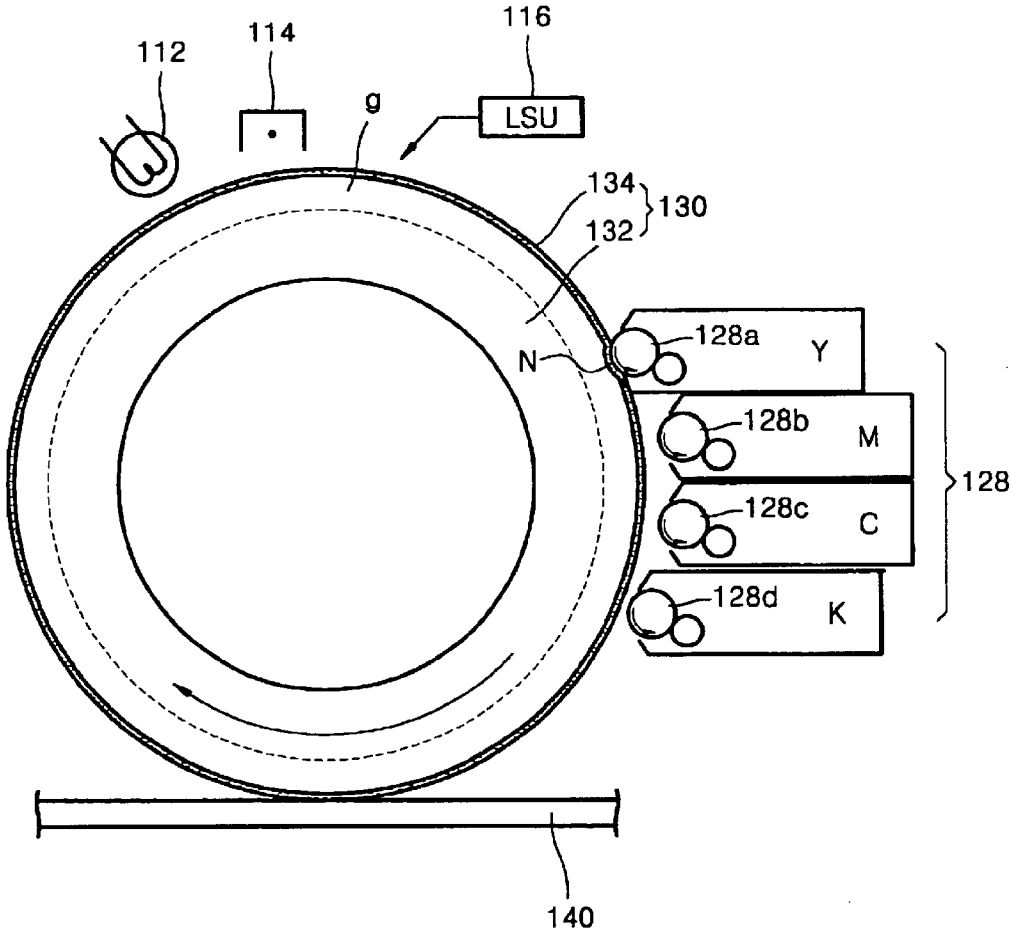
FIG. 6 is an enlarged view of a portion of the schematic view shown in FIG. 5.

Referring to FIGS. 5 and 6, the printer includes the photosensitive drum 130, an eraser 112, a charger 114, a laser scanning unit (LSU) 116, developing units 128, a transfer belt 140, a first transfer roller 142, a second transfer roller 144, and a fixing unit 160. The photosensitive drum 130 is a photosensitive body. The eraser 112 erases an electric potential on the photosensitive drum 130. The charger 114 charges the photosensitive drum 130 with the electric potential. The LSU 116 radiates light onto the photosensitive drum 130 to form a predetermined latent electrostatic image. The developing units 128 develop the latent electrostatic image with toners, each having one of four colors, i.e., yellow Y, magenta M, cyan C, and black K. The first transfer roller 142 transfers the image that is developed on the photosensitive drum 130 to the transfer belt 140. The second transfer roller 144 transfers the image having four colors that are developed on the transfer belt 140 to a paper. The fixing unit 160 hot-presses the paper to permanently fix the transferred image on the paper. The developing units 128 include four developer units 128-Y, 128-M, 128-C, and 128-K, which are spaced apart from each other from the photosensitive drum 130, sequentially move toward the photosensitive drum 130 by a contact unit (not shown), and contact developer rollers 128*a*, 128*b*, 128*c*, and 128*d* at the tips of the developer units 128-Y, 128-M, 128-C, and 128-K with the photosensitive drum 130. Reference numerals 150 and 170 represent a paper cassette and a transfer path to hold and discharge the papers, respectively.

A process of forming an image in the printer shown in FIG. 5 will now be described. The charger 114 charges the photosensitive drum 130 with a predetermined potential. The LSU 116 radiates light onto the photosensitive drum 130 to form a latent electrostatic image that will be developed with a first color in a predetermined area of the photosensitive drum 130. For example, if the first color is yellow, the yellow developer unit 128-Y contacts the photosensitive drum 130 with a contact unit. Thus, the toner that is attached to the circumferential surface of the developer roller 128*a* is transferred to the latent electrostatic image of the photosensitive drum 130 that contacts the circumferential surface of the developer roller 128*a*. Here, the developer roller 128*a* contacts the photosensitive drum 130 so as to press the air gap g formed between the rotary drum 132 and the photosensitive belt 134 with a predetermined pressure. Then, the photosensitive belt 134 is pushed toward the rotary drum 132 and forms a nip N having a predetermined width. The yellow image is well developed by the developing nip N. The developed image is transferred to the transfer belt 140 through a first transfer nip N1. A latent electrostatic image for magenta is formed by charging the photosensitive drum 130 with a predetermined potential and exposing the photosensitive drum 130 to light. The developing unit 128 develops the magenta image and transfers the developed magenta image to the transfer belt 140 through the first transfer nip N1. Cyan and black images are developed and transferred by this method, and then a desired color image is finally formed on the transfer belt 140. The color image on the transfer belt 140 is transferred to a paper that is supplied to a second transfer nip N2 between the transfer belt 140 and the second transfer roller 144. The completed color image is hot-pressed when passing through the fixing unit 160 and permanently fixed on the paper.

Figure 7:
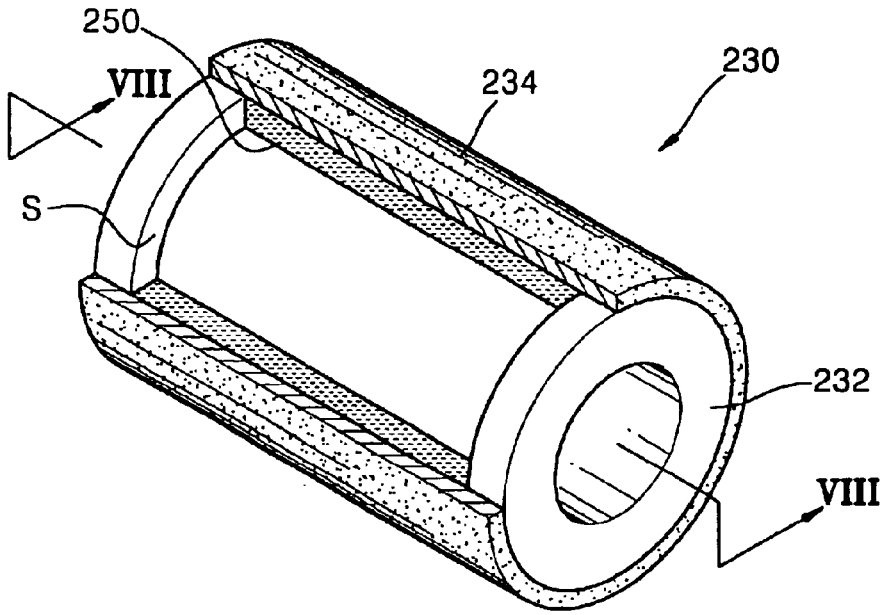
FIG. 7 is a perspective view of a photosensitive drum structure according to a second embodiment of the present invention.
Figure 8:
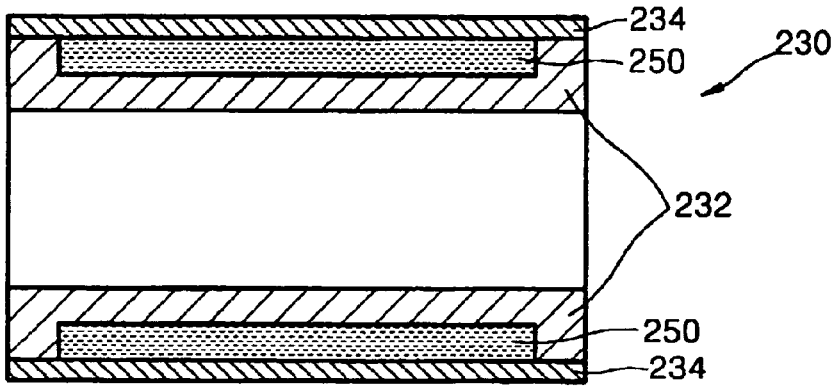
FIG. 8 is a cross-sectional view taken along line VIII—VIII of FIG. 7.

FIG. 7 is a perspective view of a photosensitive drum 230 according to a second embodiment of the present invention, and FIG. 8 is a cross-sectional view taken along line VIII–VIII of FIG. 7. The detailed description of the same elements as those in the first embodiment is omitted.

Referring to FIGS. 7 and 8, an elastic member 250, which is formed of a silicon sponge, a polyester sponge, or an elastic rubber, is inserted into the gap between a photosensitive belt 234 and a rotary drum 232.

The elastic member 250 according to the second embodiment performs a cushion operation similar to the air gap g, and thus a detailed description thereof is omitted.

As described above, in a photosensitive drum structure for an image forming apparatus according to the present invention, an inexpensive photosensitive belt is wound around a rotary drum. Thus, manufacturing costs are reduced. Also, a cushion operation is performed on the photosensitive drum so that there is contact with the developer roller, in order to obtain good development of the image.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A photosensitive drum for an image forming apparatus, the drum comprising:

a cylindrical rotary drum having steps at both ends of a circumferential surface thereof; and a photosensitive belt wound around the rotary drum and attached thereto with an adhesive adhered to the steps, wherein a gap is formed between the circumferential surface of the rotary drum and the photosensitive belt.

2. The photosensitive drum for an image forming apparatus of claim 1, wherein the gap is an air gap filled with air.

3. The photosensitive drum for an image forming apparatus of claim 1, further comprising an elastic member to fill the gap.

4. The photosensitive drum for an image forming apparatus of claim 3, wherein the elastic member is a silicon sponge or a polyester sponge.

5. The photosensitive drum for an image forming apparatus of claim 3, wherein the elastic member is formed of rubber.

6. A photosensitive drum for an image forming apparatus, the photosensitive drum comprising:

a rotary drum; and a photosensitive belt surrounding the rotary drum, wherein a gap exists between the rotary drum and the photosensitive belt.

7. The photosensitive drum for an image forming apparatus of claim 6, wherein the rotary drum comprises first and second steps on opposite ends thereof.

8. The photosensitive drum for an image forming apparatus of claim 6, wherein the gap is an air gap filled with air.

9. The photosensitive drum for an image forming apparatus of claim 6, further comprising an elastic member to fill the gap.

10. The photosensitive drum for an image forming apparatus of claim 6, wherein the photosensitive belt comprises:

a base layer;

a conductive layer stacked on the base layer; and a photosensitive layer stacked on the conductive layer.

11. The photosensitive drum for an image forming apparatus of claim 7, wherein a height of the steps defines a length of the air gap of 100 microns or more.

12. The photosensitive drum for an image forming apparatus of claim 11, wherein the height of the steps is 2 mm or less.

13. An image forming apparatus, comprising:

a photosensitive drum, comprising:

a rotary drum, and a photosensitive belt surrounding the rotary drum, wherein a gap exists between the rotary drum and the photosensitive belt; and a developing unit to develop an image on the photosensitive drum.

14. The image forming apparatus of claim 13, wherein the developing unit comprises a developer roller to press the photosensitive belt towards the rotary drum and thereby form a nip.

* * * * *